US008500472B2

(12) United States Patent
Shimoyama et al.

(10) Patent No.: US 8,500,472 B2
(45) Date of Patent: Aug. 6, 2013

(54) THIN CONNECTOR

(75) Inventors: Koichi Shimoyama, Tokyo (JP); Kiyotaka Aoki, Tokyo (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 224 days.

(21) Appl. No.: 13/070,801

(22) Filed: Mar. 24, 2011

(65) Prior Publication Data

US 2011/0237132 A1 Sep. 29, 2011

(30) Foreign Application Priority Data

Mar. 26, 2010 (JP) ..... P2010-071837

(51) Int. Cl.
*H01R 29/00* (2006.01)

(52) U.S. Cl.
USPC ..... 439/188; 439/83; 439/489; 439/630

(58) Field of Classification Search
USPC ..... 439/188, 498, 630, 83
See application file for complete search history.

(56) References Cited

U.S. PATENT DOCUMENTS

| | | | | |
|---|---|---|---|---|
| 5,352,125 | A * | 10/1994 | Banakis et al. | 439/83 |
| 5,505,629 | A * | 4/1996 | Majima et al. | 439/78 |
| 6,139,336 | A * | 10/2000 | Olson | 439/83 |
| 6,702,594 | B2 * | 3/2004 | Lee et al. | 439/83 |
| 6,719,577 | B2 * | 4/2004 | Nogami | 439/188 |
| 7,435,117 | B2 * | 10/2008 | Ma | 439/188 |
| 7,789,709 | B1 * | 9/2010 | He et al. | 439/630 |
| 2005/0059278 | A1 * | 3/2005 | Zhang | 439/83 |

FOREIGN PATENT DOCUMENTS

| | | |
|---|---|---|
| JP | 2005-243468 | 8/2005 |
| JP | 2005-246424 | 8/2005 |
| JP | 2009-076428 | 3/2009 |

* cited by examiner

*Primary Examiner* — Xuong Chung Trans
(74) *Attorney, Agent, or Firm* — Whitham Curtis Christofferson & Cook, PC

(57) ABSTRACT

A connector includes a housing and a terminal. The housing has an insertion space into which a thin insertion object is inserted. The terminal member has a supported portion supported by the housing, an elastic portion configured to be elastically deformed according to an insertion of the thin insertion object into the insertion space, and a terminal portion to be soldered to a board. The terminal portion is extended from the supported portion in a direction different form an extending direction of the elastic portion. The terminal member is configured to detect an insertion state of the thin insertion object based on a change of conduction by the elastic deformation of the elastic portion A sectional area reducing part is provided in the terminal member between the supported portion and the terminal portion. The sectional area reducing part has a sectional area smaller than a sectional area at the terminal portion.

2 Claims, 7 Drawing Sheets

THIN CONNECTOR

BACKGROUND

The present invention is related to a thin connector having a flat shape such as a connector for a card type recording medium, a connector for a flat cable terminal, or the like. Also, a thin insertion object referred in the present invention denotes a card type recording medium or a flat cable terminal.

On account of a size reduction of the recent electronic devices, a card type recording medium or a thin flat cable terminal are employed widely. Upon utilizing the thin insertion object such as the card type recording medium, the flat cable terminal, or the like, when an electric power is supplied to an equipment in a situation that the thin insertion object is not correctly inserted into the connector, the corruption of data is caused in the recording medium or the failure of equipment is caused. Therefore, the thin connector equipped with the detecting mechanism that detects whether or not the thin insertion object is correctly inserted, based on conduction/non-conduction of a cantilever that deforms due to the insertion of the thin insertion object is known (see Patent Document 1). When the thin insertion object is inserted into the thin connector, this thin insertion object pushes the cantilever, and thus the cantilever is elastically deformed to change the conductive/non-conductive states. The detecting mechanism built in the thin connector detects the insertion of the thin insertion object by detecting a change of the conduction state of the cantilever.

Meanwhile, the thin connector equipped with such detecting mechanism is surface-mounted on the substrate of the equipment. Therefore, when the thin connector is fitted onto the substrate by the reflow soldering, for example, in some cases the solder crawls up from the terminal portion of the cantilever that is fitted onto the substrate. At that time, when the solder that crawls up adheres to a cantilever main body, a stress in excess of a predetermined value is loaded onto the cantilever according to a change of a spring constant of the cantilever. As a result, there is such a possibility that the cantilever is damaged in its early stage. As the technology to prevent this solder wicking, the technology set forth in Patent Document 2 or Patent Document 3 is known.

In Patent Document 2, such a method is set forth that a solder wicking preventing area is formed on contact parts of electronic members by applying a resin or ceramics that has low wettability of solder.

Also, in Patent Document 3, such a method is known that a soldering area is formed by providing a gold plating layer, to which the solder is easy to stick, on a nickel underlying layer, and then a nickel-gold alloy that has poor wettability of solder is formed by irradiating a laser beam onto an upper part of this soldering area, and thus a solder wicking preventing area is formed on the terminal portion that is fitted by the solder.

[Patent Document 1] Japanese Patent Publication No. 2009-076428

[Patent Document 2] Japanese Patent Publication No. 2005-246424

[Patent Document 3] Japanese Patent Publication No. 2005-243468

SUMMARY

The above method needs the application of a resin, or the like, or the application of the plating process and the laser beam machining. Therefore, such a problem exists that a man-hour is increased and thus a production cost is increased.

It is therefore one advantageous aspect of the present invention to provide a thin connector equipped with an insertion detecting mechanism, which prevents a solder wicking with a simple structure and which has a long life, at a low cost.

According to one aspect of the invention, there is provided a connector to be mounted on a board, comprising:

a housing having an insertion space into which a thin insertion object is inserted;

a first terminal member configured to be pushed by the thin insertion object to be elastically deformed when the thin insertion object is inserted into the insertion space;

a second terminal member, having a supported portion supported by the housing, an elastic portion configured to be pushed by the first terminal member to be deformed according to deformation of the first terminal member, and a terminal portion to be soldered to the board, the terminal portion being extended from the supported portion in a direction different form an extending direction of the elastic portion, and;

a sectional area reducing part, provided in the second terminal member between the supported portion and the terminal portion, and having a sectional area smaller than a sectional area at the terminal portion, wherein an insertion state of the thin insertion object is detected based on a change of conduction between the first terminal member and the second terminal member.

The sectional area reducing part may be formed by an opening provided in the second terminal member.

The connector may be configured such that: the housing has a terminal covering portion covering an outer side of the terminal portion, a groove through which the second terminal member is exposed is provided at the terminal covering portion, and the opening is disposed at the groove.

The connector may be configured such that: a longitudinal direction of the supported portion is different from a longitudinal direction of the elastic portion, the second terminal member has a bent portion connecting the supported portion with the elastic portion, and the housing has a deformation allowing portion accommodating the bent portion with a clearance.

According to another aspect of the invention, there is provided a connector to be mounted on a board, comprising:

a housing having an insertion space into which a thin insertion object is inserted;

a terminal member, having a supported portion supported by the housing, an elastic portion configured to be elastically deformed according to an insertion of the thin insertion object into the insertion space, and a terminal portion to be soldered to the board, the terminal portion being extended from the supported portion in a direction different form an extending direction of the elastic portion, and;

a sectional area reducing part, provided in the terminal member between the supported portion and the terminal portion, and having a sectional area smaller than a sectional area at the terminal portion, wherein the terminal member is configured to detect an insertion state of the thin insertion object based on a change of conduction by the elastic deformation of the elastic portion.

DETAILED DESCRIPTION OF EXEMPLIFIED EMBODIMENT

An embodiment of the present invention will be explained with reference to the drawings hereinafter.

Figure 1:
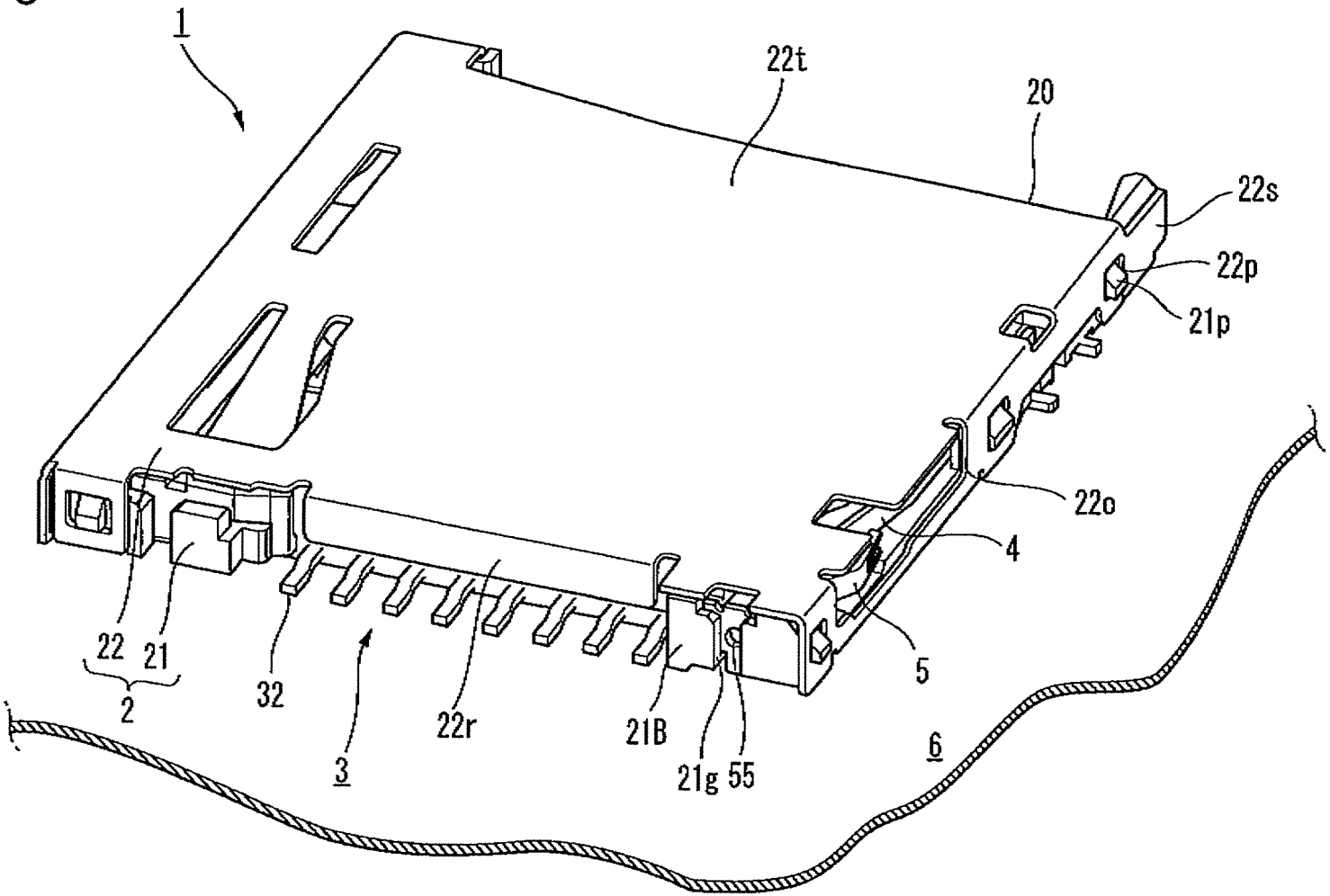
FIG. 1 is an external perspective view of a thin connector according to the present invention.

FIG. 1 is an external perspective view showing an example of a thin connector 1 according to an embodiment of the present invention. The thin connector 1 according to the embodiment of the present, invention has a housing 2, a connector terminal member 3, a first terminal member 4, and a second terminal member 5, and is surface-mounted on a substrate 6.

The housing 2 is a flat rectangular parallelepiped member that constitutes an outer shape of the thin connector 1. The housing 2 has a base body 21, and a cover 22 for covering an upper portion of the base body 21. An insertion space having an insertion port 20 is defined in the inside of the housing 2.

The base body 21 is a substantially rectangular member that is formed of a resin by using the injection molding, or the like, and is fitted to the substrate 6 of the thin connector 1. The base body 21, together with the cover 22, constitutes the insertion space into which a substantially rectangular thin insertion object 7 is inserted. The card type recording medium is Micro SD Card (registered trademark), Memory Stick (registered trademark), or the like, or the flat cable terminal. Also, the base body 21 has a first supporting portion 21A for supporting the first terminal member 4, described later, and a second supporting portion 21B for supporting the second terminal member 5, on the sides of the insertion space.

The first supporting portion 21A is constructed as a pair of projection portions that project upward from the base body 21. Respective projection portions oppose to each other at a distance that is substantially equal to a thickness of the first terminal member 4 described later, and support the first terminal member 4 so as to put it therebetween. Similarly, the second supporting portion 21B is constructed as a pair of projection portions that oppose to each other at a distance that is substantially equal to a thickness of the second terminal member 5, and support the second terminal member 5 so as to put it therebetween.

The cover 22 is a member that is constructed by bending three sides of a metal plate except one side that corresponds to the insertion port 20. The cover 22 has a top wall 22*t* that constitutes an upper surface of the thin connector 1 so as to oppose to the base body 21, two side walls 22*s* that constitute side surfaces of the thin connector 1, and a rear wall 22*r* provided on the opposite side to the insertion port 20. Projection portions 21*p* projected from the side wall of the base body 21 are fitted correspondingly into openings 22*p* provided in the side walls 22*s* of the cover 22, and thus the cover 22 is fitted onto the base body 21. The thin insertion object 7 is inserted into the insertion space, which is defined by the base body 21 and the cover 22 in the above way, toward the rear wall 22*r* of the cover 22 from the insertion port 20.

Figure 2:
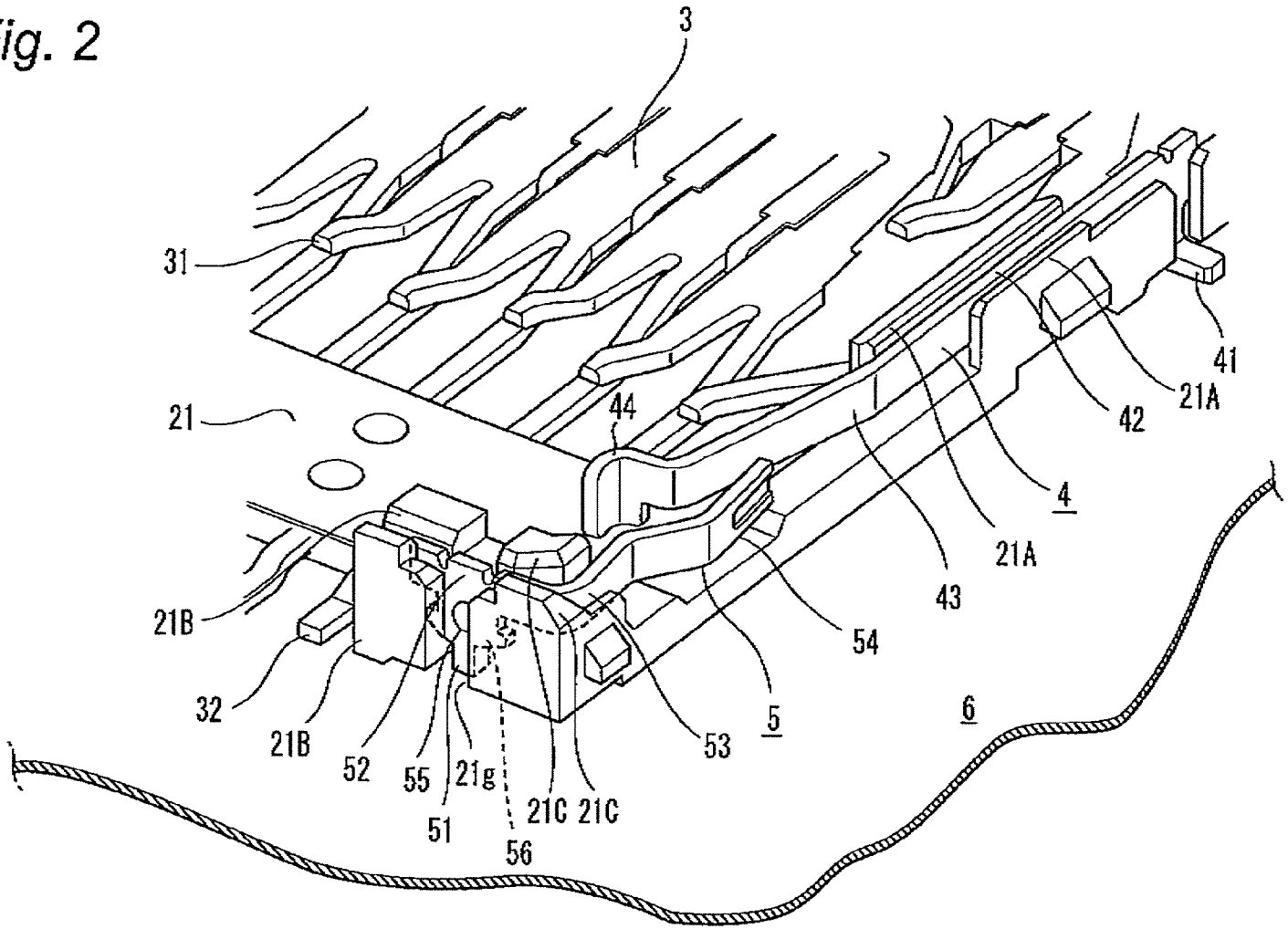
FIG. 2 is a pertinent enlarged view of the thin connector according to the present invention.

Next, the connector terminal member 3, the first terminal member 4, and the second terminal member 5 provided in the inside of the housing 2 will be explained hereunder. FIG. 2 is a pertinent enlarged view showing particularly the first terminal member 4 and the second terminal member 5 in an enlarged fashion after the cover 22 is removed, in order to explain these members.

As shown in FIG. 2, the connector terminal member 3 is provided on the substrate 6 side of the housing 2. The connector terminal member 3 is a conductive member that is formed by the blanking and the press working of metal, for example. This terminal member is used to detect an insertion state of the thin insertion object 7 by detecting a change in a conduction state, which is caused by an elastic deformation of the first terminal member 4 and the second terminal member 5 described later. The connector terminal member 3 has a plurality of insertion body side terminals 31, and a plurality of external connection terminals 32 that are connected to respective insertion body side terminals 31 and connected to the outer side of the thin connector 1. The insertion body side terminals 31 are arranged to correspond to the terminals of the thin insertion object 7 that is inserted into the insertion space, and are extended from the base body 21 toward the top wall 22*t* of the cover 2 so as to contact elastically the terminals of the thin insertion object 7.

The first terminal member 4 is a conductive elongated plate-like member that is formed by the blanking and the press working of metal, for example. The first terminal member 4 is provided to the side wall of the housing 2 along the insertion direction of the thin insertion object 7, and is arranged on the side that is located closer to the insertion port 20 than the second terminal member 5 described later.

The first terminal member 4 has a first supported portion 42 supported by the first supporting portion 21A, a first elastic piece 43 extended from the first supported portion 42 to the rear wall 22*r* of the cover 22, a first terminal portion 41 connected electrically to the substrate 6 and extended from the first supported portion 42 in the thickness direction of the substrate 6 different from the first elastic piece 43, and a contacting portion 44 for contacting the thin insertion object 7 provided to a top end of the first elastic piece 43. The first terminal portion 41 is positioned on the side that is located closer to the insertion port 20 than the first elastic piece 43. The first elastic piece 43 is extended along the insertion direction of the thin insertion object 7, and can be elastically deformed in the parallel direction to the substrate 6 with respect to the first supported portion 42. The contacting portion 44 is curved to project out to the inner side of the insertion space, and the thin insertion object 7 comes smoothly into contact with this contacting portion 44 along the curved surface when the thin insertion object 7 is inserted.

The first terminal portion 41 and the first supported portion 42 are arranged in the positions where these portions do not interfere with the inserted thin insertion object 7. In contrast, the first elastic piece 43 and the contacting portion 44 are arranged in the positions where these portions interfere with the thin insertion object 7 when the thin insertion object 7 is inserted. Therefore, when the thin insertion object 7 is inserted into the insertion space, first the top end of the thin insertion object 7 comes into contact with the first elastic piece 43, then the top end of the thin insertion object 7 slides over the first elastic piece 43 along with the insertion of the thin insertion object 7, and then the thin insertion object 7 contacts the contacting portion 44. As a result, the side surface of the thin insertion object 7 comes in touch with the contacting portion 44 in such a state that the thin insertion object 7 is inserted completely into the insertion space.

The second terminal member 5 is an elongated plate-like member that is bent like an L shape and is provided on the rear wall 22*r* side of the cover 22, which is opposite to the insertion port 20 of the insertion space. The second terminal member 5 has a second supported portion 52 supported by the second supporting portion 21B, a bent portion 53 extended from the second supported portion 52, a second elastic piece 54 extended from the bent portion 53 toward the insertion port 20, and a second terminal portion 51 connected electrically to the substrate 6 and extended from the second supported portion 52 in the thickness direction of the substrate 6 different from the second elastic piece 54. The second elastic piece 54 of the second terminal member 5 is arranged to oppose to the first elastic piece 43 of the first terminal member 4. When the thin insertion object 7 is inserted into the insertion space, the first elastic piece 43 comes into contact with the second elastic piece 54.

A spring constant of the second elastic piece 54 is set such that the second elastic piece 54 contacts the first elastic piece 43 at a predetermined pressure when the second elastic piece 54 is displaced to the outside of the insertion space by a pushing/energizing force of the first elastic piece 43. Concretely, lengths and widths of the bent portion 53 and the second elastic piece 54, which are continued from the second supported portion 52, are set with regard to a coefficient of elasticity of the second terminal member 5.

The second supported portion 52 of the second terminal member 5 is extended in parallel with the rear wall 22*r*of the cover 22, and the second elastic piece 54 is extended along the insertion direction of the thin insertion object 7. The bent portion 53 is bent by almost 90 degrees, and connects the second supported portion 52 and the second elastic piece 54. Also, the bent portion 53 is surrounded by a corner portion 21C (elastic deformation allowing portion), which extends from the second supporting portion 21B to the bent portion 53 side, via a clearance. The corner portion 21C is formed of a pair of projection portions that project upward from the base body 21, and inner walls of a pair of projection portions are shaped to fit a shape of the bent portion 53. A pair of projection portions of the corner portion 21C oppose each other and have a clearance that is larger than a moving range of the bent portion 53 such that an elastic deformation of the second elastic piece 54 is allowed.

Here, the second terminal member 5 is supported by the second supporting portion 21B. In this case, a pawl portion 56 is press-fitted into the side surfaces of the second supporting portion 21B and the corner portion 210 respectively, and thus the second terminal member 5 is fixed to the substrate 6 such that, even when a load is applied to the second terminal member 5, this second terminal member 5 is not removed from the substrate 6.

In this case, the side wall is not provided to the base body 21 on the outer side of the first elastic piece 43 and the second elastic piece 54 such that a displacement of the first elastic piece 43 and the second elastic piece 54 toward the outer side of the insertion space can be allowed. Also, for the same reason, an opening 22*o* is also provided to the cover 22 at the locations that correspond to these positions.

Figure 3:
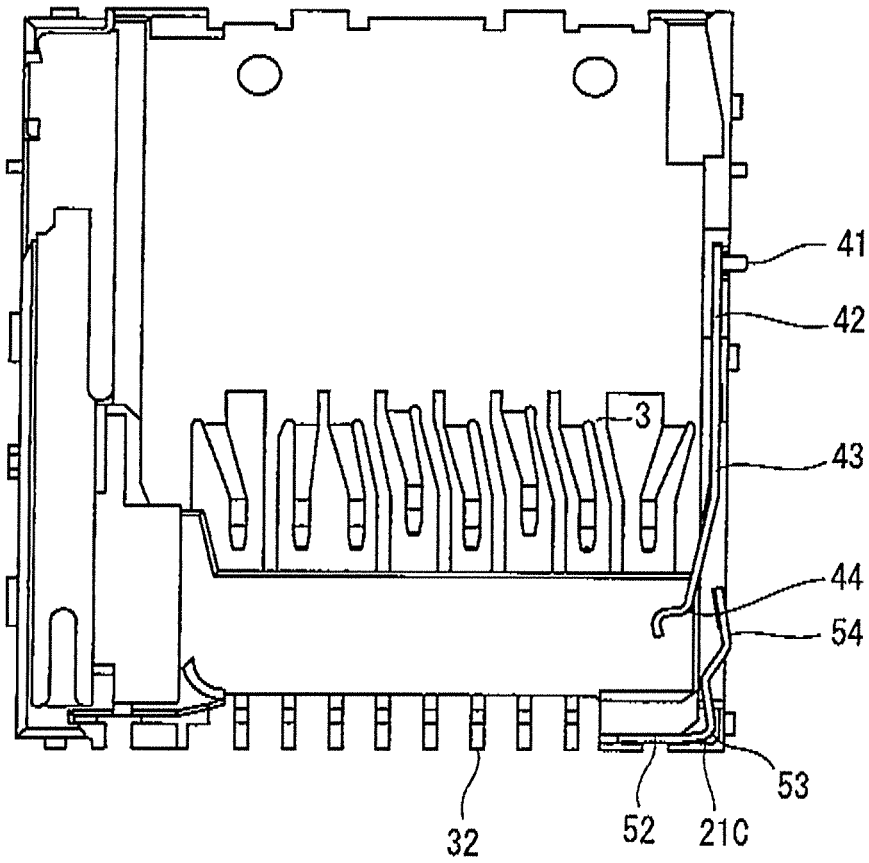
FIG. 3 is a plan view showing an operation of a detecting mechanism of the thin connector according to the present invention.
Figure 4:
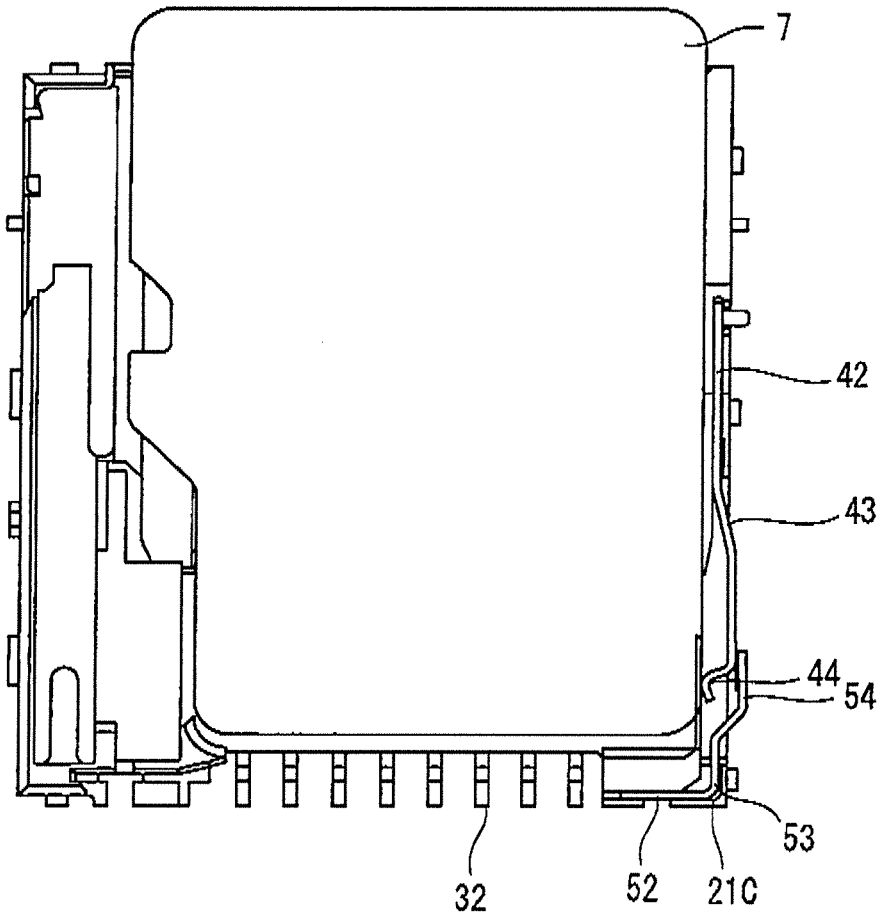
FIG. 4 is a plan view showing an operation of the detecting mechanism of the thin connector according to the present invention.

Next, actions of the first terminal member 4 and the second terminal member 5 will be explained with reference to FIG. 3 and FIG. 4 hereunder. FIG. 3 is a plan view showing a state that the thin insertion object 7 is not inserted into the thin connector 1, and FIG. 4 is a plan view showing a state that the thin insertion object 7 is inserted into the thin connector 1. Here, FIG. 3 and FIG. 4 illustrate a state that the cover 22 is removed from the thin connector 1 respectively.

As shown in FIG. 3, the first terminal member 4 and the second terminal member 5 are isolated mutually in a state that the thin insertion object 7 is not inserted into the insertion space. Thus, an electrical connection is not established between them yet.

As shown in FIG. 4, when the thin insertion object 7 is inserted into the insertion space, first the thin insertion object 7 comes into contact with the first elastic piece 43, and then the first elastic piece 43 is elastically deformed and is displaced to the outer side. When the first elastic piece 43 is deformed, the second elastic piece 54 positioned on the outer side of the first elastic piece 43 is pushed by the first elastic piece 43 and is elastically deformed toward the outer side. In this manner, when the thin insertion object 7 is inserted into the thin connector 1 and thus the first elastic piece 43 comes into contact with the second elastic piece 54, both elastic pieces are electrically connected and are brought into their conduction state. An external detecting circuit (not shown) detects the conduction between the first elastic piece 43 and the second elastic piece 54, and thus detects that the thin insertion object 7 is inserted into the thin connector 1.

The corner portion 21C and the opening 220 (see FIG. 1) are configured to permit a moving stroke of the second elastic piece 54. Therefore, even when the second elastic piece 54 is elastically deformed, such second elastic piece 54 never comes into contact with the housing 2, or the like. As a result, even when the second elastic piece 54 is elastically deformed, an external force is never loaded from the housing 2, or the like. Also, the second elastic piece 54 is elastically deformed according to the elastic deformation of the first elastic piece 43. Therefore, an excessive pressure is never loaded to the second elastic piece 54 according to the insertion of the thin insertion object 7.

In this event, when the thin insertion object 7 is inserted completely into the insertion space, such thin insertion object 7 comes into contact with the contacting portion 44 of the first terminal member 4. Thus, the contacting portion 44 and the second elastic piece 54 are kept in an elastically contacted state. Since the contacting portion 44, the first elastic piece 43, and the second elastic piece 54 are elastically deformed adequately even in this state respectively, an excessive pressure is never loaded to the first terminal member 4 and the second terminal member 5.

As described above, even when the thin insertion object 7 is inserted the housing 2, an excessive pressure is never loaded to the first terminal member 4 and the second terminal member 5. As a result, the thin connector 1 equipped with a detecting mechanism whose fatigue life is long can be implemented.

When the above thin connector 1 is mounted on the surface of the substrate 6, the external connection terminals 32 of the connector terminal member 3, the first terminal portion 41 used to feed an electric power to the first terminal member 4, and the second terminal portion 51 used to feed an electric power to the second terminal member 5 are soldered to the substrate 6. In the case where soldering is done using reflow soldering, for example, the solder being pasted on the substrate 6 crawls up along the external connection terminals 32, the first terminal portion 41, and the second terminal portion 51 and adheres thereto, so that the thin connector 1 is fixed onto the substrate 6. In some cases solder in excess of the required amount crawls up along the first and second terminal portions 41, 51. In order to prevent this solder wicking, as shown in FIG. 2, in the present invention, a sectional area reducing part 55 is provided between the second terminal portion 51 and the second supported portion 52 of the second terminal member 5.

In order to prevent solder adhering to the bent portion 53, as shown in FIG. 2, an opening is provided between the second terminal portion 51 and the second supported portion 52 of the second terminal member 5 as the sectional area reducing part 55. Upon applying soldering, heat fed from the top end of the second terminal portion 51 is supplied to the bent portion 53 via the second supported portion 52. The opening 55 for reducing a cross section between the second terminal portion 51 and the second supported portion 52 is provided between both portions. The sectional area reducing part 55 has a sectional area smaller than a sectional area at the second terminal portion 51. As a result, heat conduction from the second terminal portion 51 to the bent portion 53 during the soldering is suppressed, and the heating of the bent portion 53 is suppressed.

In the soldering step, commonly the solder spreads onto the area that is heated in excess of a melting temperature of the solder. Therefore, it is preferable that the area to which the solder is not applied should not be heated to exceed a melting temperature of the solder. According to the present invention, the opening 55 suppresses the heat conduction from the second terminal portion 51 to the bent portion 53. Therefore, even though the second terminal portion 51 is heated up to a temperature that is enough to apply the soldering, the bent portion 53 is hard to reach the temperature that is enough to apply the soldering.

Also, the opening 55 accumulates the solder that is fused and crawls up, to thus suppress the solder from further crawling up from the opening 55. Therefore, the solder can be suppressed effectively from arriving at the bent portion 53 along the second supported portion 52. In this manner, according to the present invention, solder wicking can be prevented effectively at a low cost with an extremely simple structure.

Further, in the present embodiment, the outside of the second supporting portion 21B also serves as a terminal covering portion that covers the second terminal portion 51 of the second terminal member 5. A groove 21*g* from which the second terminal member 5 is exposed is provided in this second supporting portion 21B. The direction along which the solder crawls up can be guided in any direction by this groove 21*g*. Further, because the opening 55 is provided in this groove 21*g*, the solder that crawls up along the groove 21*g* can be accumulated in the opening 55 without fail. In the present embodiment, the groove 21*g* is formed toward the second supported portion 52 from the second terminal portion 51. As a result, the solder can be guided surely to the opening 55 located between the second terminal portion 51 and the second supported portion 52, and thus the solder wicking that reaches the bent portion 53 can prevented without fail.

Figure 5:
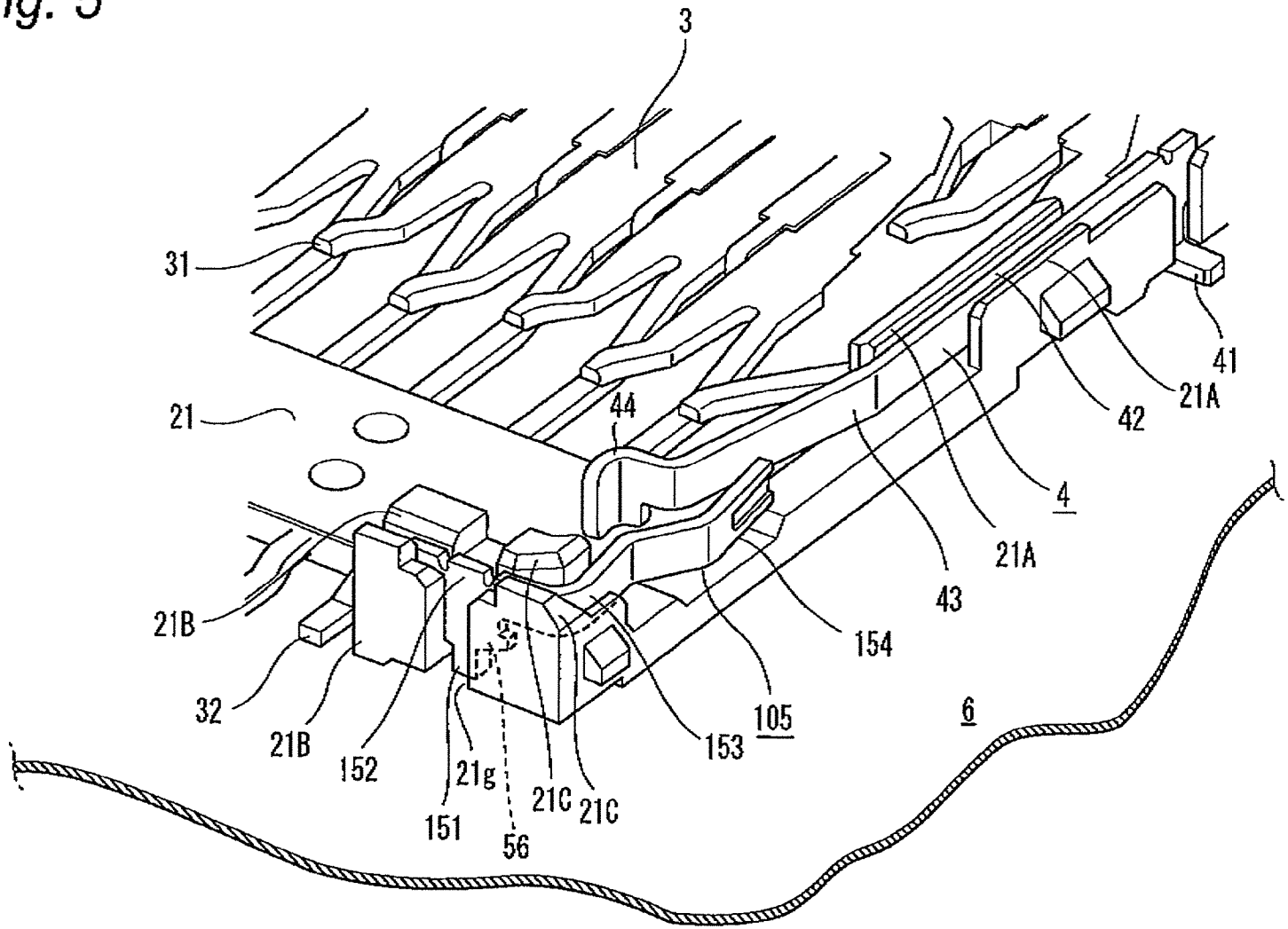
FIG. 5 is a pertinent enlarged view of a thin connector according to the comparative example.

In order to explain in detail an action of the above sectional area reducing part 55, a phenomenon of the solder wicking will be explained with reference to FIG. 5 hereunder. FIG. 5 is a pertinent enlarged view of a thin connector, in which the sectional area reducing part 55 is not provided, according to the comparative example. The thin connector according to the comparative example is similar to the above embodiment except that the sectional area reducing part is not provided to a second terminal member 105. Therefore, the same reference symbols are affixed to the same members as those in the above embodiment respectively, and their explanation will be omitted herein.

In fixing the second terminal member 105 to the substrate 6 with the solder, in a case where solder crawls up in excess of an amount required along a second terminal portion 151 of the second terminal member 105, since the second terminal portion 151 is arranged in close vicinity of a second supported portion 152 and a bent portion 153, the solder may crawl up the second supported portion 152 and then adhere to the bent portion 153. In particular, the corner portion 21 C is continued from the second supporting portion 21B, and also a clearance is formed between the corner portion 21C and the second terminal member 105. Therefore, the solder that crawls up along the second terminal portion 151 is ready to enter into a space between the bent portion 153 and the corner portion 21C through this clearance. When the solder crawls up along the second terminal portion 151 and enters into the space between the bent portion 153 and the corner portion 21C, an originally set length of a second elastic piece 154, which is extended from the second supported portion 152 (in other words, a free-end length of a cantilever) is made short. since the second terminal portion 151 is arranged in close vicinity of a second supported portion 152 and a bent portion 153, the solder may crawl up the second supported portion 152 and then adhere to the bent portion 153. In particular, the corner portion 21 C is continued from the second supporting portion 21B, and also a clearance is formed between the corner portion 21C and the second terminal member 105. Therefore, the solder that crawls up along the second terminal portion 151 is ready to enter into a space between the bent portion 153 and the corner portion 21C through this clearance. When the solder crawls up along the second terminal portion 151 and enters into the space between the bent portion 153 and the corner portion 21C, an originally set length of a second elastic piece 154, which is extended from the second supported portion 152 (in other words, a free-end length of a cantilever) is made short.

When a length of the second elastic piece 154 is shortened, a spring constant of the second elastic piece 154 is increased. Then, even when the second elastic piece 154 is displaced over the same distance, a pressure that is higher than that applied in such a situation that the solder did not adhere to the bent portion 153 is applied to the second elastic piece 154 in such a situation that the solder adhered to the bent portion 153. In particular, in the thin connector whose height dimension is small, a thickness and a width of the second terminal member 105 are small, and thus the influence exerted upon a spring constant is increased even when a length dimension is changed slightly. As a result, a pressure that is higher than that is expected originally is applied to the second elastic piece 154 every time when the thin insertion object 7 is inserted/pulled out, and thus a fatigue life of the second terminal member 105 is shortened considerably rather than a designed value.

Figure 6:
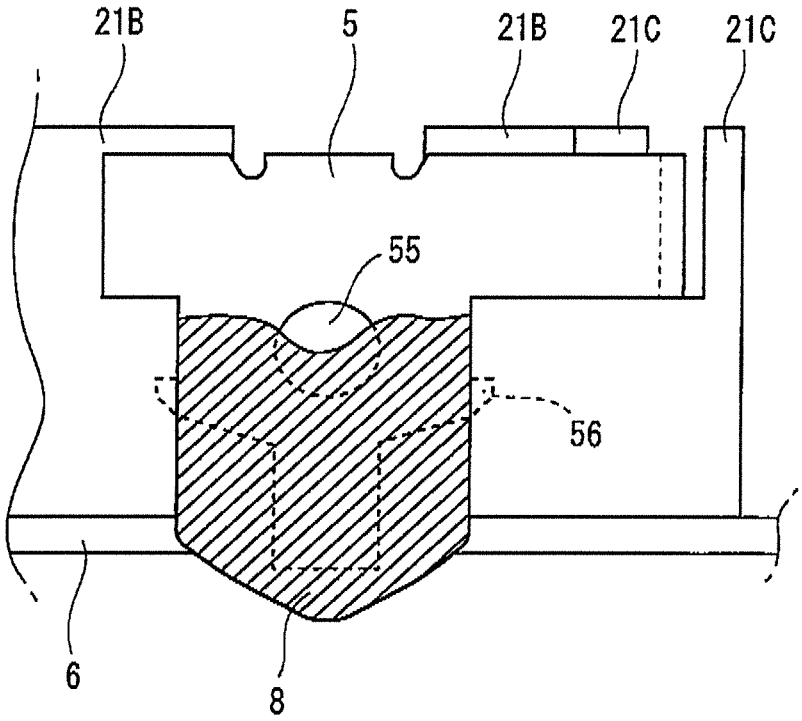
FIG. 6 is a schematic view showing a solder applied state of the thin connector according to the present invention.
Figure 7:
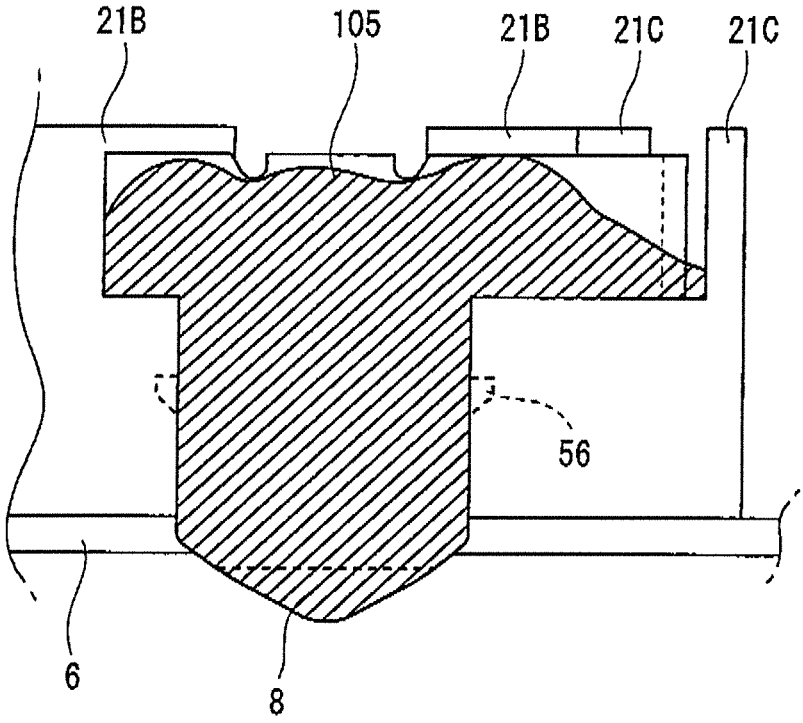
FIG. 7 is a schematic view showing a solder applied state of the thin connector according to the comparative example.

The effect of the above sectional area reducing part 55 is illustrated in FIGS. 6, 7 hereunder. FIGS. 6, 7 are schematic views showing a solder applied state of the thin connector according to the present invention and the thin connector according to the comparative example respectively, and show the second terminal members 5, 105 after the thin connector is fixed to the substrate 6 with the solder, respectively. In FIGS. 6, 7, a hatched portion indicated by a reference numeral 8 denotes the solder respectively.

As shown in FIG. 6, in the thin connector in which the sectional area reducing part 55 is provided according to the present invention, this sectional area reducing part 55 suppresses a heat transfer from the second terminal portion 51 to the second supported portion 52. Therefore, solder 8 never reaches the second supported portion 52 and the bent portion 53 through the sectional area reducing part 55. However, as shown in FIG. 7, in the thin connector in which the sectional area reducing part 55 is not provided according to the comparative example, solder 8 arrives at the second supported portion 152 and the bent portion 153, and thus it is possible that the second terminal member 105 is damaged in its early stage.

As described above, as shown in FIG. 6, when the sectional area reducing part 55 is provided between the second terminal portion 51 and the second supported portion 52, the solder wicking along the bent portion 53 can be prevented effectively with a simple structure, and the damage of the second terminal member 5 caused in the early stage can be prevented.

In the above embodiment, the explanation is made by illustrating such a structure that the opening 55 for preventing the solder wicking is provided to the second terminal member 5 only. However, it is of course that the opening 55 may be provided to the first terminal member 4 only or both the first terminal member 4 and the second terminal member 5.

In the above embodiment, such an example is illustrated that the first elastic piece 43 and the second elastic piece 54 can be elastically deformed with respect to the side surface of the thin insertion object 7. But the present invention is not limited to this example. For example, it is apparent that the first elastic piece 43 and the second elastic piece 54 may be constructed to displace in the thickness direction of the thin insertion object 7.

Also, in the above embodiment, such an example is illustrated that, when the thin insertion object 7 is inserted, the first terminal member 4 and the second terminal member 5 are brought into their conduction state whereas, when the thin insertion object 7 is not inserted, both members are brought into their non-conduction state. But the present invention is not limited to this example. It is apparent that, when the thin insertion object 7 is inserted, both members may be brought into their non-conduction state whereas, when the thin insertion object 7 is not inserted, both members are brought into their conduction state.

Further, in the above embodiment, such an example is illustrated that the sectional area reducing part is constructed by the opening 55. A notched portion that is formed by notching at least one of the second terminal portion 51 and the second supported portion 52 in the width direction (in the direction in parallel with the substrate 6) may be provided between them. Also, in the above embodiment, the sectional area reducing part 55 is explained as a single opening. But it is apparent that a plurality of openings may be provided. As described above, any means may be used sufficiently as the sectional area reducing part 55 if such means can suppress the heat conduction from the second terminal portion 51 to the second supported portion 52, and its profile is not limited.

Although only some exemplary embodiments of the invention have been described in detail above, those skilled in the art will readily appreciated that many modifications are possible in the exemplary embodiments without materially departing from the novel teachings and advantages of the invention. Accordingly, all such modifications are intended to be included within the scope of the invention.

What is claimed is:

1. A connector to be mounted on a board, comprising:

a housing having an insertion space into which a thin insertion object is inserted;

a first terminal member configured to be pushed by the thin insertion object to be elastically deformed when the thin insertion object is inserted into the insertion space;

a second terminal member, having a supported portion supported by the housing, an elastic portion configured to be pushed by the first terminal member to be deformed according to deformation of the first terminal member, and a terminal portion to be soldered to the board, the terminal portion being extended from the supported portion in a direction different form an extending direction of the elastic portion, and;

a sectional area reducing part, provided in the second terminal member between the supported portion and the terminal portion, and having a sectional area smaller than a sectional area at the terminal portion, wherein an insertion state of the thin insertion object is detected based on a change of conduction between the first terminal member and the second terminal member, the sectional area reducing part is defined by a notched portion formed by notching a part of the second terminal between the terminal portion and the supported portion in a width direction of the terminal portion, the housing has a terminal covering portion covering an outer side of the terminal portion, a groove through which the second terminal member is exposed is provided at the terminal covering portion, and the notched portion is disposed at the groove so that a solder flowing up along the groove is retained in the notched portion.

2. The connector according to claim 1, wherein a longitudinal direction of the supported portion is different from a longitudinal direction of the elastic portion, the second terminal member has a bent portion connecting the supported portion with the elastic portion, and the housing has a deformation allowing portion accommodating the bent portion with a clearance.

* * * * *